US005169261A

United States Patent [19]

Barnes et al.

[11] Patent Number: 5,169,261

[45] Date of Patent: Dec. 8, 1992

[54] PRE-PACKAGED BITUMINOUS SANDSTONE FOR REPAIRING PAVEMENT

[76] Inventors: James L. Barnes, 727 S. Orange Grove Blvd., No. 7, Pasadena, Calif. 91105; Dennis S. Barnes, 1867 W. Gordon Creek Rd., Price, Utah 84501

[21] Appl. No.: 690,746

[22] Filed: Apr. 24, 1991

[51] Int. Cl.[5] ..... E01C 11/08

[52] U.S. Cl. ..... 404/75; 404/67; 106/276; 206/524.1; 206/811

[58] Field of Search ..... 404/17, 67, 69, 71, 404/72, 75; 106/273.1, 276, 281.1, 283, 316, 823

[56] References Cited

U.S. PATENT DOCUMENTS

| | | | |
|---|---|---|---|
| 3,074,807 | 1/1963 | Dorius et al. | 404/17 X |
| 3,366,500 | 1/1968 | Kracauer | 106/283 X |
| 3,818,291 | 6/1974 | McConnaughay | 404/75 |
| 3,868,263 | 2/1975 | McConnaughay | 106/282 X |
| 3,923,537 | 12/1975 | Wood | 106/283 X |
| 4,227,933 | 10/1980 | McAllister | 106/283 X |
| 4,256,506 | 3/1981 | Mendenhall | 404/72 X |
| 4,373,961 | 2/1983 | Stone | 106/281.1 |
| 4,859,502 | 8/1989 | Astrope et al. | 427/139 |
| 4,964,752 | 10/1990 | Astrope et al. | 404/111 X |

*Primary Examiner*—Thuy M. Bui
*Assistant Examiner*—Roger J. Schoeppel
*Attorney, Agent, or Firm*—Nilsson, Wurst & Green

[57] ABSTRACT

A pre-packaged bituminous sandstone material, which can be applied to damaged pavement areas at ambient temperatures, is prepared by comminuting bituminous sandstone in the presence of water to form an intimate mixture of bituminous sandstone having particles which pass through a one-quarter inch minus screen, preferably through a one-eighth inch minus screen with sufficient water, to form a material having a water content of from about 3% to about 20%, based on the weight of the mixture. The mixture is then packaged in a vapor-proof container, to maintain its water content. Damaged pavement is subsequently repaired simply by removing the mixture from the container and applying the material, at ambient temperatures, to the damaged areas.

22 Claims, No Drawings

PRE-PACKAGED BITUMINOUS SANDSTONE FOR REPAIRING PAVEMENT

BACKGROUND OF THE INVENTION

1. Field of the Invention

This invention relates to materials for repairing pavement surfaces and methods for their repair. In particular, it relates to naturally occurring bituminous sandstone material and its use in "cold patch" repair of pavement surfaces.

2. Discussion of the Prior Art

Pavement surfaces, by their very nature, are subject to continuous wear by their users, i.e. by the constant travel of pedestrians, automobiles, and aircraft. Pavement surfaces are also subject to degradation, because they are exposed to the elements, i.e. rain, snow and extreme temperatures. As a result, pavement surfaces are repeatedly damaged by the formation of cracks, potholes, and the like. Consequently, there is a great need for materials which can be simply and inexpensively used to repair such damage to pavement surfaces.

One method for repairing pavement surfaces is known as "hot patch" repair. Hot patch repair employs a tar-like material which is heated to approximately 400° F. and then immediately forced into damaged areas. A major drawback of hot patch materials and methods is that they require relatively expensive equipment to heat the tar-like material on-site. Further, the method generally requires that the damaged pavement be pretreated with a preliminary coating of a base material to provide sufficient bonding between the material and the damaged area.

Another method of repair is described in U.S. Pat. No. 4,859,502, which patent is herein incorporated by reference. The method employs mixing bituminous sandstone with 20 to 56% water by weight, to form a slurry having a temperature of from 110°-210° F. The slurry is then pumped through a conduit and applied to the area to be repaired. Among the disadvantages of the method disclosed in this patent is the cost of the equipment needed to form the hot slurry and then pump the hot material to the damaged area.

Attempts have also been made to use bituminous sandstone, in cold patch repair—i.e., without heating. In central Utah, where large deposits of bituminous sandstone exist, roads are initially constructing using this material. When road damage occurs additional bituminous sandstone is used to repair the holes without special processing or treatment. Unfortunately, the naturally occurring material is difficult to work with, because it is typically mined in aggregate chunks which are difficult to reduce to a uniform grain size. Accordingly, the untreated material is not effective in filling cracks and other damaged areas, where the consistency of the bituminous sandstone is of importance.

SUMMARY OF THE INVENTION

Now in accordance with the invention there has been found a pre-packaged bituminous sandstone material which can be applied to damaged pavement areas at ambient temperatures, without the need for a preliminary coat of base material. Naturally occurring bituminous sandstone is comminuted in the presence of water to form an intimate mixture of bituminous sandstone having particles which pass through a one-quarter inch minus screen, preferably through a one-eighth inch minus screen with sufficient water, to form a material having a water content of from about 3% to about 20%, preferably from about 10% to about 18%, based on the weight of the mixture. In some embodiments, the mixture additionally contains an aggregate, such as recycled asphalt.

The mixture is then packaged in a vapor-proof container, to maintain its water content. The material remains stable and in a workable condition, throughout transportation and storage, as long as it is sealed in the package.

Damaged pavement is subsequently repaired simply by removing the mixture from the container and applying the material, at ambient temperatures, to the damaged areas. Once the mixture has set, it forms a strong and effective repair which is impervious to water and has both good adhesion and ductility.

DETAILED DESCRIPTION OF THE PREFERRED EMBODIMENTS

Bituminous sandstones are naturally occurring materials, which contain sandstone particles impregnated with and bound together by variable amounts of bitumen. Any naturally occurring bituminous sandstone material can be used in accordance with the invention. A preferred material is found at the Asphalt Ridge area in Unitah County, Utah. Representative Asphalt Ridge area material contains from about 8% to about 12% bitumen, where the bitumen is comprised of 19% asphaltenes, 45% resins, 32% cyclic oils and 4% naphthenes.

The bituminous sandstone is comminuted in the presence of water, using conventional grinding machines A preferred grinding machine is a hammermill. The resulting bituminous sandstone has particles which pass through a one-quarter inch minus screen, preferably through a one-eighth inch minus screen and a water content of from about 3% to about 20%, preferably from about 10% to about 18%, based on the weight of the mixture.

Particle sizes greater than those which can pass through a one-quarter minus inch screen are not desirable, because the resulting material is too course to be easily applied to damaged areas, such as cracks. Particle sizes less than those of the sandstone particles contained in the bituminous sandstone are not desirable, because of the practical difficulties in obtaining such sizes.

A water content above about 20% is not desirable, because the excess water increases transportation costs and increases the time it takes the material to set, after its application to a damaged area. A water content below about 3% is not desired, because there is insufficient water to prevent the material from prematurely setting, prior to its application at the site of pavement damage.

In some embodiments, particularly those embodiments where the material is to be applied to areas which are greater than about one inch in size, such as pot holes, the material is admixed with an aggregate. Sand is a preferred aggregate. It is an advantage of the product and process in accordance with the invention that recycled asphalt also can be used as the aggregate.

The aggregate can be added to the material, after it has been ground in the presence of water. Alternatively, the bituminous sandstone can be admixed with the aggregate, heated to a temperature sufficient to soften the bitumen. Representative apparatuses for admixing bituminous sandstone with hot aggregate include mixers and recyclers used in conventional hot mix processes.

The bituminous sandstone and the hot aggregate are mixed for a time sufficient to separate the sandstone particles from one another. Typical temperatures are from about 200° F. to about 450° F. Water is then added to the mixture so that the final product has a water content of from about 3% to about 20%, preferably from about 10% to about 18%, based on the weight of all the components. The aggregate-containing mixture is then packaged in a vapor-proof container.

In some embodiments, the mixture contains conventional setting inhibitors, such as solvents. Also in some embodiments, setting the mixture contains conventional freezing inhibitors.

The material is then packaged in a vapor-proof container, to maintain the water content of the mixture. Illustrative containers include metal cans and plastic cans and bags. Once sealed in the vapor-proof container the material remains stable throughout storage and transportation to the damaged site. The material remains in a plastic or workable condition, until the container is opened, just prior to repair.

The material can be used to repair any pavement surface, including both asphalt and cement pavement surfaces. The damaged area is cleaned of sand and other debris, preferably by hosing with water. The material is then applied, at ambient temperatures, by tamping or forcing the material into the damaged areas. It is an advantage of the invention that no preliminary coat of base material is required.

In some embodiments additional water is added to the mixture, so that it has the consistency of wet sand. In these embodiments, a squeegee or cement float is used to smooth the surface of the repaired area.

Setting typically takes from about six to about twenty-four hours, depending on the weather conditions and depth of the treated area. Once the material has set, it forms a strong and effective repair having both good adhesion and ductility.

What I claim is:

1. A pre-packaged material for repairing pavement surfaces comprising a vapor-proof container containing an intimate mixture of naturally occurring bituminous sandstone having particles which pass through a one-quarter inch minus screen and a water content of from about 3% to about 20%, based on the weight of the mixture.

2. A pre-packaged material in accordance with claim 1, wherein the bituminous sandstone has particles which pass through a one-eighth inch minus screen and a water content of from about 10% to about 18%, based on the weight of the mixture.

3. A pre-packaged material in accordance with claim 2, wherein the intimate mixture is obtained by comminuting bituminous sandstone in the presence of water.

4. A pre-packaged material in accordance with claim 2, wherein the bituminous sandstone is obtained from the Asphalt Ridge area of Unitah County, Utah.

5. A pre-packaged material in accordance with claim 2, wherein the intimate mixture further comprises an aggregate.

6. A pre-packaged material in accordance with claim 5, wherein the aggregate is sand or recycled asphalt.

7. A pre-packaged material in accordance with claim 6, wherein the aggregate is recycled asphalt.

8. A pre-packaged material in accordance with claim 5, wherein the intimate mixture is obtained by admixing the bituminous sandstone with the aggregate, where the aggregate has a temperature of from about 200° F. to about 450° F., for a time sufficient to separate said sandstone particles from one another and then adding water to the resulting admixture.

9. A pre-packaged material in accordance with claim 1, wherein the intimate mixture is obtained by comminuting bituminous sandstone in the presence of water.

10. A pre-packaged material in accordance with claim 1, wherein the bituminous sandstone is obtained from the Asphalt Ridge area of Unitah County, Utah.

11. A pre-packaged material in accordance with claim 1, wherein the intimate mixture further comprises an aggregate.

12. A pre-packaged material in accordance with claim 11, wherein the aggregate is sand or recycled asphalt.

13. A pre-packaged material in accordance with claim 12, wherein the aggregate is recycled asphalt.

14. A pre-packaged material in accordance with claim 11, wherein the intimate mixture is obtained by admixing the bituminous sandstone with the aggregate, where the aggregate has a temperature of from about 200° F. to about 450° F., for a time sufficient to separate said sandstone particles from one another and then adding water to the resulting admixture.

15. A method for repairing a pavement surface having a damaged area comprising applying an intimate mixture of naturally occurring bituminous sandstone having particles which pass through a one-quarter inch minus screen with sufficient water to form a water content of from about 3% to about 20%, based on the weight of the mixture, where said mixture has an ambient temperature, and allowing the mixture to set.

16. A method in accordance with claim 15, wherein the bituminous sandstone has particles which pass through a one-eighth inch minus screen and a water content of from about 10% to about 18%, based on the weight of the mixture.

17. A method in accordance with claim 15, wherein the intimate mixture further comprises an aggregate.

18. A method in accordance with claim 16, wherein the intimate mixture further comprises an aggregate.

19. A method in accordance with claim 17, wherein the aggregate is sand aggregate or recycled asphalt aggregate.

20. A method in accordance with claim 18, wherein the aggregate is sand aggregate or recycled asphalt aggregate.

21. A method in accordance with claim 19, wherein the aggregate is recycled asphalt aggregate.

22. A method in accordance with claim 20, wherein the aggregate is recycled asphalt aggregate.

* * * * *